United States Patent [19]

Kubiatowicz

[11] 4,268,990

[45] May 26, 1981

[54] TOY ACTIVATING MECHANISM

[75] Inventor: James F. Kubiatowicz, Minneapolis, Minn.

[73] Assignee: Custom Concepts, Incorporated, Minneapolis, Minn.

[21] Appl. No.: 7,712

[22] Filed: Jan. 30, 1979

[51] Int. Cl.[3] ..... A63H 11/00

[52] U.S. Cl. ..... 46/119; 46/171; 46/191; 185/37; 185/DIG. 1

[58] Field of Search ..... 46/118, 119, 141, 171, 46/189, 191; 185/37, 38, 39, DIG. 1

[56] References Cited

U.S. PATENT DOCUMENTS

| | | | |
|---|---|---|---|
| 2,504,679 | 4/1950 | Goldfarb | 46/189 |
| 2,662,334 | 12/1953 | Fishlove | 46/171 X |
| 2,766,849 | 10/1956 | Rüdiger | 185/37 |
| 2,931,135 | 4/1960 | Zalkind | 46/118 |
| 3,009,265 | 11/1961 | Bezark | 46/171 X |
| 3,230,664 | 1/1966 | Bornn et al. | 46/171 X |
| 3,941,212 | 3/1976 | Lechner | 185/37 |
| 3,990,177 | 11/1976 | Daraux | 46/191 |

*Primary Examiner*—F. Barry Shay

*Attorney, Agent, or Firm*—William L. Huebsch

[57] ABSTRACT

A toy activating mechanism including first and second relatively movable portions, a rotor mounted on the first portion and rotated relative thereto by a wound rubber band with parts of the rubber band rubbed along a surface on the first portion to slow rotation of the rotor relative thereto. The rotor has a row of projections that engage a protrusion on the second part to cause the relative motion as the rotor turns.

8 Claims, 8 Drawing Figures

TOY ACTIVATING MECHANISM

BACKGROUND OF THE INVENTION

The present invention relates to mechanisms in toys for causing movement of parts of the toys relative to each other.

SUMMARY OF THE INVENTION

The present invention provides a toy including an activating mechanism powered by a manually wound rubber band, which mechanism can produce slow, intermittent, sometimes periodic and sometimes sporadic relative movement between two portions of the mechanism.

The activating mechanism in the toy according to the present invention comprises a first portion including a wall having an opening and an annular friction surface around the opening, and a post spaced from the side of the wall opposite the friction surface adapted to engage portions of the rubber band with other portions of the rubber band extending through said opening. Also included is a rotor having tabs adapted to retain portions of the rubber band thereabout and being shaped to position the parts of the rubber band adjacent the retained portions against the friction surface to restrict rotation of the rotor relative to the first portion under the influence of wound portions of the rubber band between the post and the rotor. The first portion and a second portion are mounted for relative pivotal movement about an axis, and cam means are provided on the rotor and the second portion for causing relative pivotal motion between the portions upon rotation of the rotor.

In a preferred embodiment the toy is in the form of a set of false teeth so the mechanism causes the teeth to intermittently open and close.

BRIEF DESCRIPTION OF THE DRAWING

The invention will be more completely explained with reference to the accompanying drawing where like numbers refer to like parts in the several views, and wherein.

DESCRIPTION OF THE PREFERRED EMBODIMENT

Figure 1:
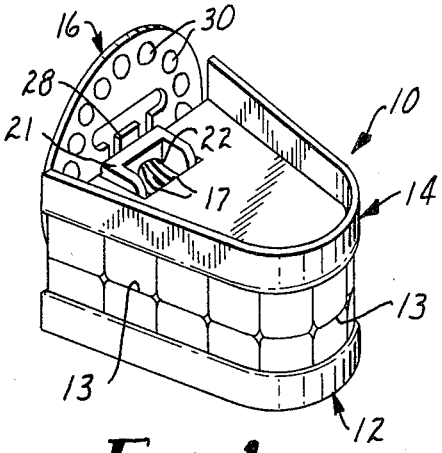
FIG. 1 is a perspective view of a toy according to the present invention.
Figure 2:
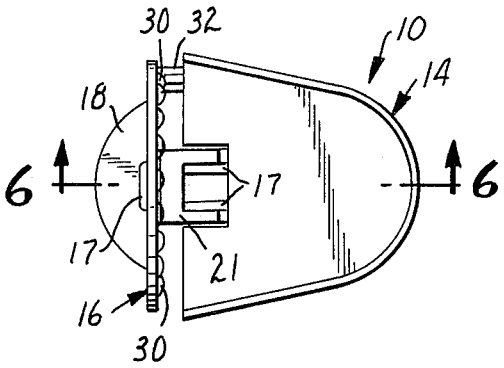
FIG. 2 is a top view of the toy shown in FIG. 1.
Figure 3:
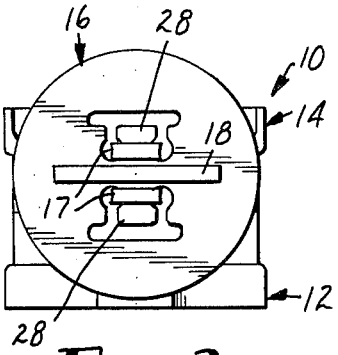
FIG. 3 is a rear elevational view of the toy shown in FIG. 1.
Figure 4:
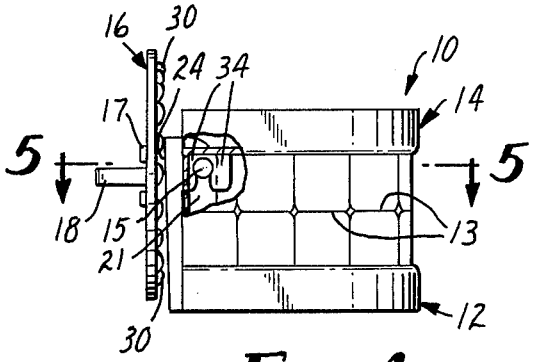
FIG. 4 is a side elevational view of the toy shown in FIG. 1 having a part broken away to show details.
Figure 5:
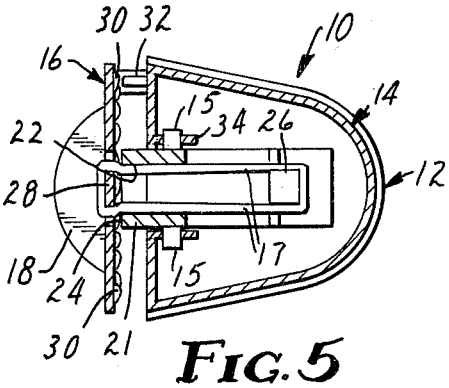
FIG. 5 is a sectional view taken approximately along lines 5—5 of FIG. 4.
Figure 6:
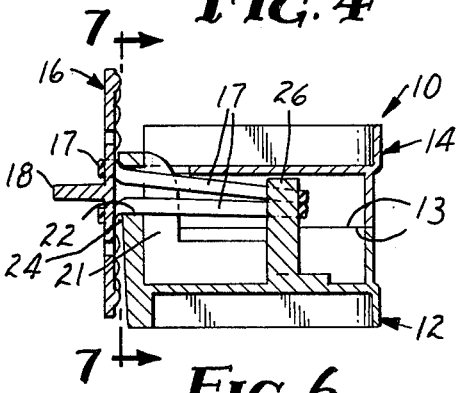
FIG. 6 is a sectional view taken approximately along lines 6—6 of FIG. 2.
Figure 7:
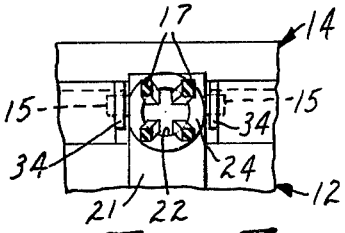
FIG. 7 is a fragmentary sectional view taken approximately along lines 7—7 of FIG. 6.

Referring now to the drawing, there is shown a toy including an activating mechanism according to the present invention generally designated by the reference numeral 10.

Figure 8:
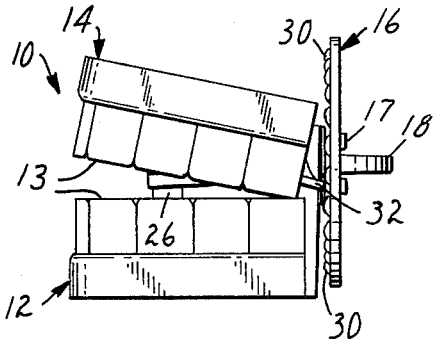
FIG. 8 is an elevational view of the toy shown in FIG. 1 from its side opposite that shown in FIG. 2, but showing portions of the toy in an open position.

The toy 10 comprises a base or first portion 12 shaped in the form of the lower half of a set of teeth, a second or upper portion 14 shaped in the form of the upper half of a set of teeth and mounted on the base portion 12 at a pair of axially aligned outwardly projecting pins 15 for pivotal movement about the axis of the pins 15 relative to the base portion 12 between a closed position wih edges 13 of the portions 12 and 14 in contact (FIGS. 1 through 7), and an open position (FIG. 8) with the edges 13 spaced from each other; and a mechanism including a rotor 16 rotated by a rubber band 17 after the rubber band 17 is wound by manual rotation of the rotor 16 (which winding is facilitated by a transverse axially projecting, manually engageable fin 18 on the rotor 16) and including means for causing slow rotation of the rotor 16 so that cam means on the rotor 16 and the upper portion 14 will cause slow, intermittent, sometimes periodic and sometimes sporadic relative movement between the upper and lower portions 12 and 14 to simulate a set of teeth opening and closing.

The means for causing such pivotal movement of the upper portion 14 relative to the base portion 12 comprises means for restricting rotation of the rotor 16 under the influence of the rubber band 17, and cam means having portions on the rotor 16 and on the upper portion 14 adapted for intermittent engagement to cause pivotal movement of the upper portion 14 upon rotation of the rotor 16.

The base portion 12 includes an end wall comprising an upwardly projecting channel-like portion 21 having an opening 22 through its distal end, and an annular friction surface 24 around the opening 22. The base portion 12 also includes an upwardly projecting post 26 spaced from the side of the channel-like portion 21 opposite the friction surface 24 and adapted to have the central portions of the rubber band 17 engaged around it (see FIGS. 5 and 6). The end portions of the rubber band 17 extend through the opening 22, and engage around the bases of tabs 28 defined in the rotor 16 by slots around their peripheries with the rubber band 17 being tensioned to pull the rotor 16 toward the channel-like portion 21 of the end wall. The width and spacings of the tabs 28 at their bases are such that the parts of the rubber band just adjacent the portions thereof extending around the tabs 28 pass over the friction surface 24 at equally spaced locations around the friction surface 24 and are pressed against the annular friction surface 24 by tension in the rubber band 17 pulling the rotor 16 toward the base portion 12. Thus those four parts of the rubber band 17 rub along the annular friction surface 24 as the rotor 16 rotates. Such rubbing has been found to produce slow rotational movement of the rotor 16 relative to the base portion 12.

The cam means includes a spaced circular array of hemispherical projections 30 on the side of the rotor 16 adjacent the base portion 12, which projections 30 are centred about the axis of the rotor 16, and a finger-like protrusion 32 from the upper portion 14 adaped to be intermittently engaged by the projections 30 to move the upper portion from its closed position (to which it is biased by its weight) to its open position as the rotor revolves the projections 30 past the protrusion 32.

Preferably the base portion 12, upper portion 14 and rotor 16 are molded of a stiff polymeric material (e.g., polyethylene or styrene), which molding may be facilitated by molding the channel-like portion 21 of the end wall at 90 degrees to the post 26 with the channel-like portion 21 attached to the edge of the balance of the base portion 12 via a thin hinge section at its base (not shown) so that after molding the channel-like portion 21 can be pivoted to the position illustrated in the drawing by bending the hinge section, at which illustrated position the channel-like portion 21 will be retained by the tension in the rubber band 17.

To assemble and use the toy 10, a person first hooks the end portions of the rubber band 17 around the tabs 28 in the rotor 16 from the side of the rotor 16 on which the projections 30 are disposed, inserts the central portions of the rubber band through the opening 22 from the side of the channel-like portion 21 on which the friction surface 24 is disposed, and stretches the central portions of the rubber band 17 around the post 26. He then presses spaced bifurcated fingers 34 on the upper portion 14 along opposite sides of the pins 15 to position the pins 15 in clearance openings adjacent the attached ends of the fingers 34 so that the upper portion 14 is pivotably mounted on the base portion 12. The user then winds the rotor 16 via manual engagement of the fin 18 to wind the portions of the rubber band 17 between the rotor 16 and post 26, and then releases the rotor 16. Subsequently the parts of the rubber band 17 adjacent the tabs 28 will rub along the annular friction surface 24 to slow rotation of the rotor 16, and the projections 30 on the rotor 16 will serially and intermittently engage the protrusion 32 on the upper portion 14 to cause movement of the upper portion 14 to its open position during such engagements and return motion to its closed position between such engagements.

Typically the rotor 16 will initially move to cause slow, intermittent, somewhat periodic movement of the upper portion at first (e.g., one opening movement every one to two seconds) and will decrease to cause intermittent sporadic movement of the upper portion 14 as the rubber band 17 unwinds (e.g., very slow, intermittent movements occurring after time spans varying between ten to thirty seconds), which can be a source of amusement, particularly where, as illustrated, the toy 10 is in the form of a set of false teeth.

It has been found that to reliably produce such movement, the friction surface 24 should be smoothly radiused on its inner edge around the opening 22, and that the rubber band 17 should contain a high percentage of rubber (as opposed to fillers).

It will be appreciated by those skilled in the art that many changes could be made in the structure of the mechanism without departing from the spirit of the invention. For example, two rubber bands can be used, each having one end on a different one of the tabs 28 and its opposite end around the post 26, which would probably facilitate assembly of the toy 10 by young children.

Also, while the mechanism is shown incorporated in the toy 10 in the form of a set of false teeth, it will be appreciated that the mechanism could be used to produce relative movement in various types of toys. Therefore, the scope of the invention should not be limited by the structure shown in the drawing but only by the language of the claims.

I claim:

1. A toy activating mechanism adapted to be operated by a common rubber band, said mechanism comprising:

a first portion including a wall having an opening and an annular friction surface around said opening, and a fixed post spaced from the side of said wall opposite said friction surface adapted to engage portions of a said rubber band with other portions of said rubber band extending through said opening;

a rotor having tabs adapted to retain portions of a said rubber band thereabout for assembly of said rotor to said first portion adjacent said wall, said rotor being shaped to position the parts of said rubber band adjacent said retained portions against said friction surface to restrict rotation of said rotor relative to said first portion under the influence of wound portions of said rubber band between said post and said rotor;

a second portion;

means for mounting said first and second portions to one another for relative pivotal movement about an axis; and cam means on said rotor and said second portion for causing relative pivotal motion between said portions upon rotation of said rotor.

2. A mechanism according to claim 1 wherein said rotor has a circular array of projections and said second portion has a protrusion extending normal to said axis and being positioned to be engaged by said projections to cause relative pivotal motion between said first and second portions upon engagement of one of said projections with said protrusion, said projections and said protrusion providing said cam means.

3. A mechanism according to claim 1 wherein said first and second portions are in the form of a set of teeth.

4. A mechanism according to claim 1 or claim 2 wherein said first portion provides a base and said second portion is mounted for pivotal motion on said first portion.

5. A toy activating mechanism, comprising:

a rubber band;

a first portion including a wall having an opening and an annular friction surface around said opening, and a fixed post spaced from the side of said wall opposite said friction surface adapted to engage portions of said rubber band with other portions of said rubber band extending through said opening;

a rotor having tabs retaining portions of said rubber band thereabout and being shaped to position the parts of said rubber band adjacent said retained portions against said friction surface to restrict rotation of said rotor relative to said first portion under the influence of wound portions of said rubber band between said post and said rotor;

a second portion;

means for mounting said first and second portions to one another for relative pivotal movement about an axis; and cam means on said rotor and said second portion for causing relative pivotal motion betweeen said portions upon rotation of said rotor.

6. A mechanism according to claim 5 wherein said rotor has a circular array of projections and said second portion has a protrusion extending normal to said axis and being positioned to be engaged by said projections to cause relative pivotal motion between said first and second portions upon engagement of one of said projections with said protrusion, said projections and said protrusion providing said cam means.

7. A mechanism according to claim 5 wherein said first and second portions are in the form of a set of teeth.

8. A mechanism according to claim 5 or claim 6 wherein said first portion provides a base and said second portion is mounted for pivotal motion on said first portion.

* * * * *